188-365

7/1/85 XR 4,597,476

United States Patent [19]

Wenker

[11] Patent Number: 4,597,476

[45] Date of Patent: Jul. 1, 1986

[54] HYDRAULIC GEROTOR MOTOR AND PARKING BRAKE FOR USE THEREIN

[75] Inventor: Wayne B. Wenker, Hopkins, Minn.

[73] Assignee: Eaton Corporation, Cleveland, Ohio

[21] Appl. No.: 726,942

[22] Filed: Apr. 25, 1985

Related U.S. Application Data

[63] Continuation of Ser. No. 481,972, Apr. 4, 1983, abandoned.

[51] Int. Cl.[4] ..... F16D 55/12; F16H 57/10; B60K 41/26

[52] U.S. Cl. ..... 192/3 R; 192/4 R; 74/411.5; 188/366

[58] Field of Search ..... 192/4 A, 4 R, 3 N, 17 A, 192/3 A, 4 B, 3 R; 74/411.5, 804, 805; 418/61 B; 188/67, 69, 31, 60, 366

[56] References Cited

U.S. PATENT DOCUMENTS 1,387,156 8/1921 Igo et al. ..... 188/31 X
2,449,459 9/1948 Eckert ..... 188/60 X
2,954,849 10/1960 Bigos ..... 188/31 X
3,616,882 11/1971 White ..... 192/4 B
3,960,470 6/1976 Kinder ..... 192/3 N

OTHER PUBLICATIONS

GR-M publication, Tokyo Instrument, Sep. 12, 1981.
Ausco publication, Failsafe Brakes, Jun. 1982.

*Primary Examiner*—George H. Krizmanich
*Attorney, Agent, or Firm*—C. H. Grace; L. J. Kasper

[57] ABSTRACT

A lock mechanism for use in association with a gerotor displacement mechanism of the type including an internally-toothed ring (23) and an externally-toothed star (27). The lock mechanism includes a lock member (81) and an actuation mechanism (83) including a backup member (85) which engages the lock member and an actuator (89). The actuator is in threaded engagement with a boss portion (71) of the ring whereby rotation results in movement radially inwardly, forcing the lock member into its adjacent volume chamber (29) to engage one of the external teeth of the star and prevent further orbital and rotational movement of the star.

25 Claims, 4 Drawing Figures

HYDRAULIC GEROTOR MOTOR AND PARKING BRAKE FOR USE THEREIN

CROSS REFERENCE TO RELATED APPLICATION

This application is a continuation of U.S. application Ser. No. 481,972, filed Apr. 4, 1983, now abandoned.

BACKGROUND OF THE DISCLOSURE

The present invention relates to hydraulic motors of the gerotor type, and more particularly, to a parking brake for use in such motors.

Although the present invention may be utilized in hydraulic devices functioning as pumps, it is especially advantageous when used with a device operating as a motor, and will be described in connection therewith.

Hydraulic motors utilizing gerotor displacement mechanisms have been popular for many years for low speed high torque applications. Such motors typically include a housing defining a fluid inlet and a fluid outlet and a gerotor gear set associated with the housing. The gerotor gear set normally includes an internally-toothed ring fixed to the housing, and an externally-toothed star eccentrically disposed within the ring for orbital and rotational movement relative to the ring. The teeth of the ring and star interengage to define expanding and contracting volume chambers during the relative movement. A valve means within the housing operates in response to the relative movement to communicate fluid from the fluid inlet to the expanding fluid chambers, and from the contracting fluid chambers to the fluid outlet. An output shaft extends from the housing and is rotatably supported thereby, and a shaft member has a first end connected to the star and a second end connected to the output shaft, to transmit the orbital and rotational movements of the star into a low speed high torque rotational movement of the output shaft.

As is well known to those skilled in the art, various arrangements of gerotor motors are known other than that described above wherein the ring is fixed to the housing and the star orbits and rotates, and although the invention may be applied advantageously to such other gerotor motor arrangements, as will be described subsequently, the above-described arrangement is the most common and constitutes the preferred embodiment of the invention.

Low speed high torque gerotor motors are frequently used to propel the drive wheels of vehicles, thus making it desirable for the motor to include some form of parking brake. Another major use of such motors is to drive vehicle accessories, such as hoists and winches, and in this type of application it is desirable for the motor to have a "load holding" capability.

One attempt by those working in the prior art to provide a motor equipped with a parking brake is shown in U.S. Pat. No. 3,616,882 in which a thin, flexible friction member can be selectively pressure biased into engagement with an end face of the gerotor star. However, it appears that such an arrangement would result in excessive friction and generated heat, with the possibility of galling the end surface of the star. In addition, the parking brake shown in the cited reference is not positive acting, but instead, depends upon the presence of hydraulic pressure.

Another approach to the need for a positive acting brake has been the use of a disc pack, with some of the discs being splined to the fixed housing, and alternating discs being splined to the rotating output shaft. Typically, the discs are spring biased into engagement (braking) and hydraulic pressure is required to disengage the discs. In one commercial embodiment, the disc pack is disposed within the housing of the gerotor motor and is operable to lock the motor output shaft to the motor housing. This approach requires almost total redesign of the motor housing and output shaft, thus making it economically impractical to offer a parking brake as a motor option. In another commercial design, a separate parking brake package engages the motor output shaft and has its own housing and separate output shaft which can be locked together by engagement of a disc pack. This separate parking brake has the advantage that it can be added as an option, because no major modification of the motor is required, but the cost of the commercially available parking brake may be as much or more than the gerotor motor itself.

SUMMARY OF THE INVENTION

Accordingly, it is an object of the present invention to provide a rotary fluid pressure device having an integral parking brake (lock) which does not involve any change in, or addition to the hydraulic circuit of the motor.

It is another object of the present invention to provide such a parking brake which is failsafe in operation, i.e., provides a positive mechanical lock to prevent rotation of the motor output shaft.

It is another object of the present invention to provide such a parking brake which is integral with the motor, but which may be added to the motor as an option at reasonable expense, without requiring substantial redesign of the motor.

The above and other objects of the present invention are accomplished by the provision of an improved rotary fluid pressure device of the type described. The device is characterized by a lock member operably associated with the internally-toothed member and disposed at least partially within one of the volume chambers. The device includes actuation means operably associated with the lock member and operable to move the lock member between first and second positions. In the first position the lock member is disposed to permit normal orbital and rotational movement of the tooth members. In the second position, the lock member extends a sufficient distance into the volume chamber to engage one of the external teeth of the externally-toothed member as the volume chamber approaches a minimum chamber volume, to prevent further orbital movement of the member having orbital movement, thereby preventing rotation of the member having rotational movement.

DESCRIPTION OF THE PREFERRED EMBODIMENT

Figure 1:
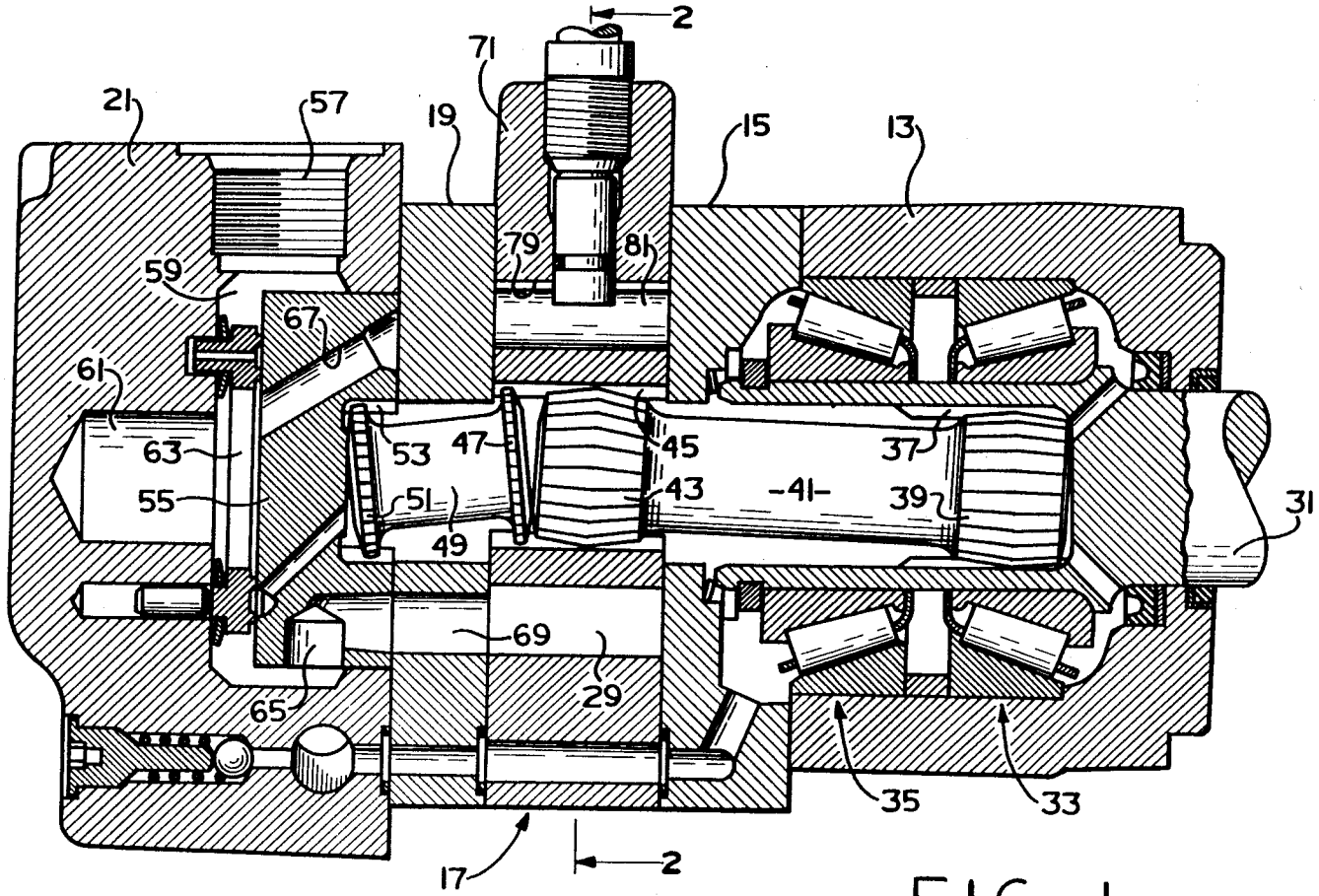
FIG. 1 is an axial cross section showing a low speed high torque gerotor motor of the type to which the present invention may be applied.

Referring now to the drawings, which are not intended to limit the invention, FIG. 1 illustrates a low speed high torque gerotor motor of the type to which the present invention may be applied and which is illustrated and described in greater detail in U.S. Pat. Nos. 3,572,983 and 4,343,600, both of which are assigned to the assignee of the present invention, and are incorporated herein by reference.

Figure 2:
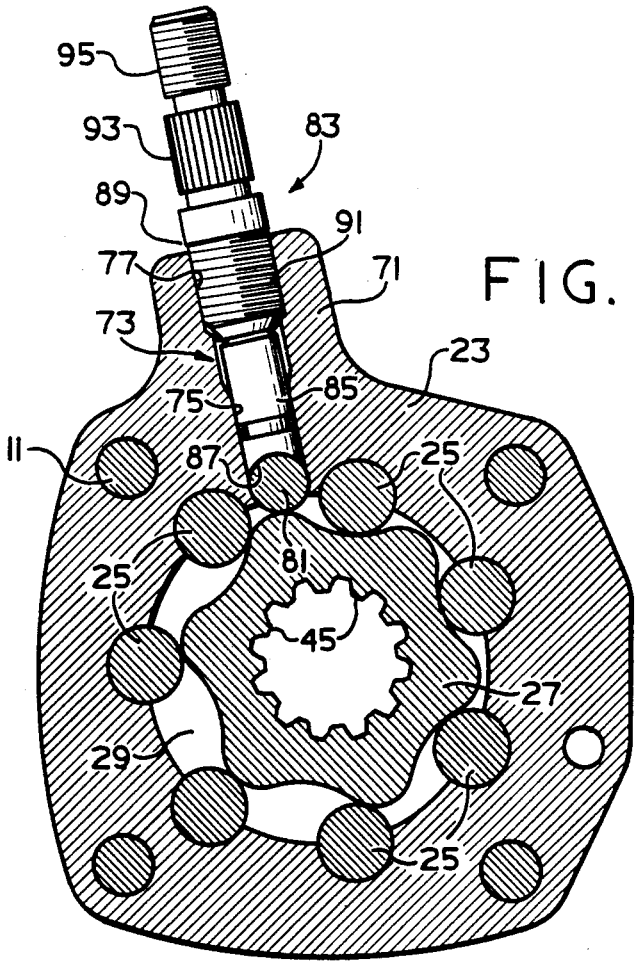
FIG. 2 is a transverse cross section taken on line 2—2 of FIG. 1, and on the same scale as FIG. 1, illustrating the motor lock of the present invention.

The hydraulic motor shown in FIG. 1 comprises a plurality of sections secured together, such as by a plurality of bolts 11 (shown in only in FIG. 2). The motor includes a shaft support casing 13, a wear plate 15, a gerotor displacement mechanism 17, a port plate 19, and a valve housing portion 21.

The gerotor displacement mechanism 17 is well known in the art, is shown and described in great detail in the incorporated patents, and will be described only briefly herein. More specifically, the displacement mechanism 17 is a Geroler ® mechanism comprising an internally-toothed ring 23 defining a plurality of generally semi-cylindrical openings, with a cylindrical member 25 disposed in each of the openings which serve as the internal teeth of the ring 23. Eccentrically disposed within the ring 23 is an externally-toothed star 27, typically having one less external tooth than the number of cylindrical members 25, thus permitting the star 27 to orbit and rotate relative to the ring 23. The relative orbital and rotational movement between the ring 23 and star 27 defines a plurality of expanding and contracting volume chambers 29.

Referring still to FIG. 1, the motor includes an output shaft 31 positioned within the shaft support casing 13 and rotatably supported therein by suitable bearing sets 33 and 35. The shaft 31 includes a set of internal, straight splines 37, and in engagement therewith is a set of external, crowned splines 39 formed on one end of a main drive shaft 41. Disposed at the opposite end of the main drive shaft 41 is another set of external, crowned splines 43, in engagement with a set of internal, straight splines 45, formed on the inside diameter of the star 27. Therefore, in the subject embodiment, because the ring 23 includes seven internal teeth 25, and the star 27 includes six external teeth, six orbits of the star 27 result in one complete rotation thereof, and one complete rotation of the main drive shaft 41 and the output shaft 31.

As is well known to those skilled in the art, the drive shaft 41 always has its axis disposed at an angle relative to the main axis of the motor, i.e., the axis of the ring 23 and of the output shaft 31. The primary function of the drive shaft 41 is to transmit torque from the gerotor star 27 to the output shaft 31. This is accomplished by translating the orbital and rotational movement of the star 27 into pure rotational motion of the output shaft 31.

Also in engagement with the internal splines 45 is a set of external splines 47 formed about one end of a valve drive shaft 49 which has, at its opposite end, another set of external splines 51 in engagement with a set of internal splines 53 formed about the inner periphery of a valve member 55. The valve member 55 is rotatably disposed within the valve housing 21. The valve drive shaft 49 is splined to both the star 27 and the valve member 55 in order to maintain proper valve timing therebetween, as is generally well known in the art.

The valve housing 21 includes a fluid port 57 in communication with an annular chamber 59 which surrounds the valve member 55. The valve housing 21 also includes an outlet port 61 which is in fluid communication with a chamber 63 disposed between the valve housing 21 and valve member 55. The valve member 55 defines a plurality of alternating valve passages 65 and 67, the passages 65 being in continuous fluid communication with the annular chamber 59, and the passages 67 being in continuous fluid communication with the chamber 63. In the subject embodiment, there are six of the passages 65, and six of the passages 67, corresponding to the six external teeth of the star 27. The port plate 19 defines a plurality of fluid passages 69 (only one of which is shown in FIG. 1), each of which is disposed to be in continuous fluid communication with the adjacent volume chamber 29. Motors of the type shown in FIG. 1 are commercially available, and are well known to those skilled in the art, and for any further details regarding the construction or operation of such a motor, reference should be made to the above-incorporated patents.

Motor Lock

Figure 3:
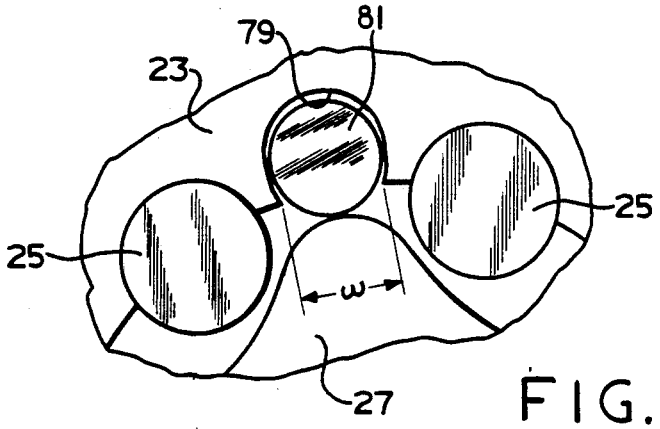
FIG. 3 is an enlarged, fragmentary view, similar to FIG. 2, but taken as a plan view of the gerotor displacement mechanism.

Referring now to FIGS. 2 and 3, in conjunction with FIG. 1, the motor lock of the present invention will be described. As may best be seen in FIGS. 1 and 2, the internally-toothed ring 23 includes a generally radially-extending boss portion 71. The boss portion 71 defines a radially-extending opening 73, which extends radially inward and opens into one of the volume chambers 29. The opening 73 includes an inner, smooth bore portion 75, and an outer larger, threaded portion 77.

The bore portion 75 is intersected by an axially oriented, upside down U-shaped recess 79 (see FIG. 3). The recess 79 preferably extends the entire axial length of the ring 23. Disposed within the recess 79 is an elongated, generally cylindrical lock member 81. The lock member 81 is retained within the recess 79 because the opening defined by the intersection of the recess 79 and volume chamber 29 has a circumferential width w which is less than the diameter of the lock member 81 (see FIG. 3). As may best be seen in FIGS. 2 and 3, the recess 79 is disposed circumferentially between a pair of adjacent internal teeth 25. Also, it should be noted in FIG. 3 that the configuration of the recess 79 permits some radial movement of the lock member 81, the purpose of which will be described subsequently.

Associated with the radial opening 73 is an actuation mechanism, generally designated 83. The actuation mechanism 83 includes a generally cylindrical back-up member 85 disposed within the bore portion 75. The back-up member 85 includes an O-ring member disposed between it and the bore portion 75 to prevent fluid leakage past the member 85 when the adjacent volume chamber 29 contains pressurized fluid. The back-up member 85 includes a surface 87 which defines a portion of a cylinder and engages the cylindrical lock member 81.

The actuation mechanism 83 further includes an actuator 89 disposed in the opening 73, adjacent the end of the back-up member 85. The actuator 89 includes an externally-threaded portion 91 which is in threaded engagement with the threaded portion 77 of the opening 73. The actuator 89 also includes a serrated portion 93 which is adapted to receive a handle member (not shown), whereby movement of the handle member results in rotation of the actuator 89, and movement either radially inwardly, or radially outwardly, depending upon the direction of movement of the handle. The actuator 89 also includes another externally-threaded portion 95, adapted to be in threaded engagement with a nut (not shown) for retention of the handle.

Operation

Referring now primarily to FIG. 2, the operation of the motor lock of the present invention will be described. When it is desired to permit the motor to operate in its normal fashion, i.e., with the star 27 engaging in its normal orbital and rotational movement with respect to the ring 23, the lock mechanism is placed in an unactuated condition. This is accomplished by moving the handle (not shown) to rotate the actuator 89 in a direction which results in movement upward in FIG. 2, radially away from the star 27. Such movement of the actuator 89 will permit orbital movement of the star 27 to force the lock member 81 and back-up member 85 radially upward toward the actuator 89. Normally, because of the O-ring surrounding the back-up member 85, the member 85 will then remain in this upward position, as described above. However, the lock member 81 will remain free to move radially within the recess 79, first moving radially upwardly whenever one of the teeth of the star 27 enters the volume chamber adjacent the lock member 81, causing that volume chamber to approach the minimum chamber volume (see FIG. 3). Then, as the star 27 continues to orbit, and the adjacent volume chamber increases in volume, the lock member 81 will be free to move radially inwardly, merely under the force of gravity, back to the position shown in FIG. 2.

When it is desired to actuate the lock mechanism, in the manner of a vehicle parking brake, or as a load holding device on a winch, the handle is moved the opposite direction to rotate the actuator 89 in the opposite direction, causing it to move radially inwardly. The inward movement of the actuator 89, by virtue of the threaded engagement between the portion 91 and threaded portion 77, forces the back-up member 85 radially inwardly. The inward movement of the member 85 moves the lock member 81 to its radially inner most position, as shown in FIG. 2. Now, however, in the actuated condition of the device, the lock member 81 is maintained fixed in the inward most position, and as the star 27 orbits, one of the external teeth of the star enters the adjacent volume chamber. Instead of the external tooth of the star 27 causing the volume chamber to reach the minimum chamber volume, as during normal operation, the external tooth engages the lock member 81, and is prevented from moving further into the volume chamber. Thus, further orbital movement of the star 27 is prevented, as is further rotational movement of the star, relative to the ring.

It should be understood by those skilled in the art that the mode of operation described above would be the same in any device in which there is relative orbital and rotational movement between the star 27 and the ring 23, regardless of which member engages in which movement. For example, it is known to have the star 27 only orbit, while the ring 23 only rotates, and various other combinations are known. The lock mechanism of the present invention may be applied in a device using any of the possible combinations of relative orbital and rotational movement.

It should be noted that in accordance with the present invention, the amount of radial movement of the lock member 81, actuation member 83 and back-up member 85, between the unactuated and actuated conditions, is quite small. Typically, radial movement of less than 0.100 inches (2.54 mm) is sufficient, and in the subject embodiment, a movement of only 0.060 inches (1.53 mm) was required. It will be understood by those skilled in the art that the amount of radial movement required is in each case a function of the geometry of the particular gerotor displacement mechanism.

FIG. 4 Embodiment

Figure 4:
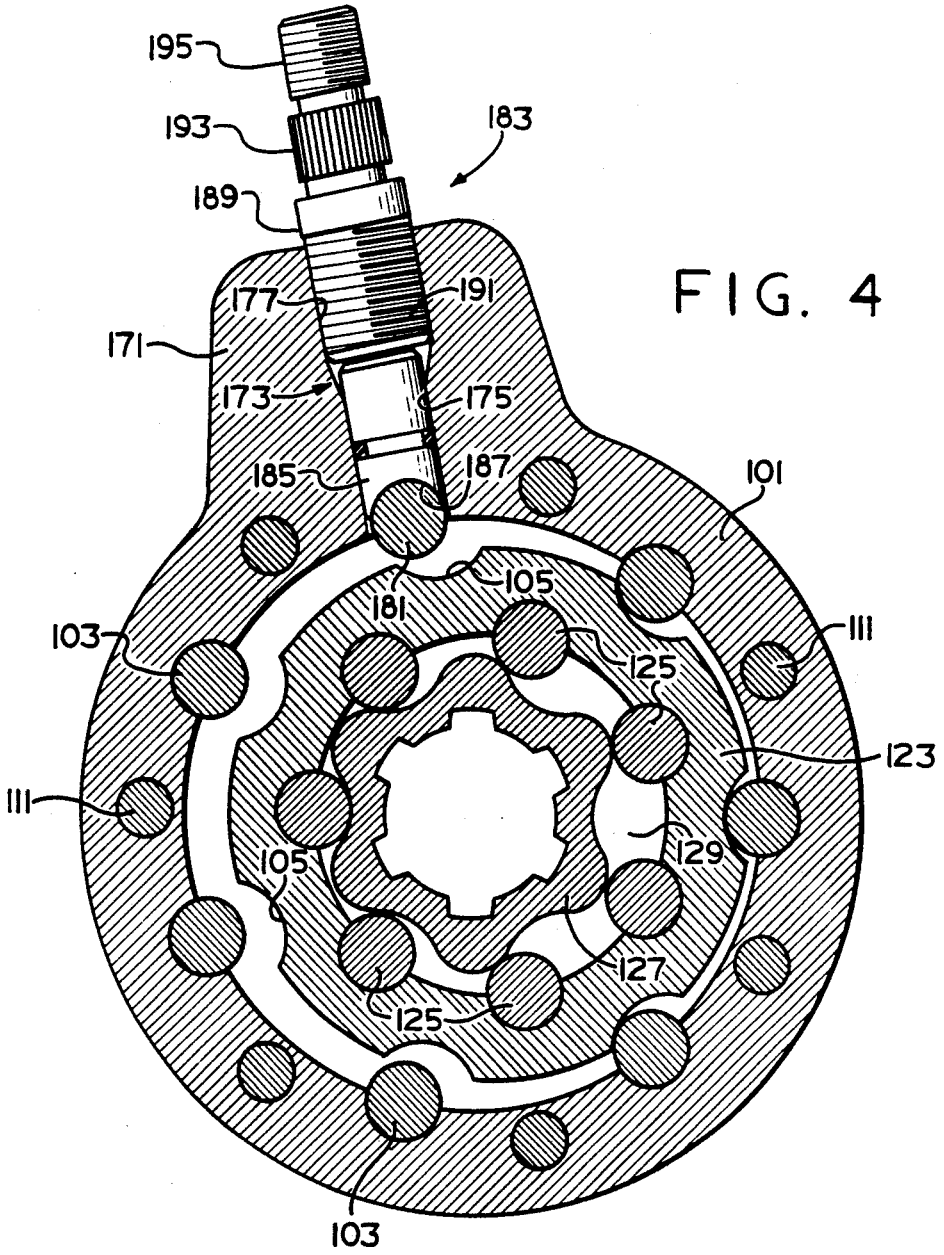
FIG. 4 is a transverse cross section, similar to FIG. 2, illustrating the use of the present invention in an alternative type of rotary fluid pressure device.

Referring now to FIG. 4, there is illustrated the use of the present invention in an alternative type of rotary fluid pressure device. In the FIG. 4 embodiment, elements which are the same or similar to those shown in FIG. 2 bear the same reference numeral, plus 100, while totally new elements bear reference numerals beginning with 101. Accordingly, the device shown in FIG. 4 includes a housing 101 which receives the plurality of bolts 111. Disposed within the housing 101 is the internally-toothed ring 123 including the internal teeth (cylindrical members 125). Eccentrically disposed within the ring 123 is an externally-toothed star 127, and the relative orbital and rotational motion between the ring 123 and star 127 are the same as in the FIG. 2 embodiment. However, in the FIG. 4 embodiment, the star 127 only rotates, while the ring 123 only orbits.

The housing 101 defines a plurality of semi-circular cutouts, each of which receives a roller 103. The ring 123 defines, about its outer periphery, a plurality of arcuate cutouts 105, each of which corresponds to one of the rollers 103. As is well known in the art, communication of fluid to and from the expanding and contracting volume chambers 129 will cause the ring 123 to orbit, while the engagement of the rollers 103 in the cutouts 105 prevents the ring 123 from rotating, thus permitting solely rotational motion of the star 127.

The housing 101 includes a boss portion 171 which defines an opening 173 including a bore portion 175 and threaded portion 177. Disposed within the opening 173 is an actuation mechanism 183, including a back-up member 185 defining a surface 187. The mechanism 183 further includes an actuator 189 having a threaded portion 191, a serrated portion 193, and another threaded portion 195. All of the elements just described may be of the same structure as the corresponding elements in the FIG. 2 embodiment.

Upon actuation of the mechanism 183, which is accomplished in the same way as in the FIG. 2 embodiment, the adjacent roller is moved radially inwardly, and thus, that particular roller may also be considered a lock member 181. With the lock member 181 in the actuated position, normal orbital movement of the ring 123 is prevented, and therefore, normal rotational movement of the star 127 is also prevented.

Although the preferred embodiment utilizes rotation of a threaded member to effect radial movement of the lock member 81, it should be apparent that other forms of actuation could be used. For example, fluid pressure could be communicated to the upper end of the back-up member 85 to bias the member 85 and the lock member 81 inwardly to the actuated position. Also, various other mechanical arrangements could be utilized, such as some form of axial movement of a wedging member, to move the lock member inwardly. It would also be possible to have the lock member 81 enter the volume chamber axially, rather than radially.

It should be apparent to those skilled in the art that the present invention provides a simple, inexpensive and efficient way of locking the gerotor displacement mechanism in the manner of a parking brake or a load holding device. The present invention makes it possible to accomplish this without the need to add any additional sections to the motor, and as shown in the FIG. 2 embodiment, only the gerotor ring 23 is modified, all other parts are the same as in the standard motor. Thus, the present invention makes it possible to provide a motor lock with no substantial increase in the size or weight of the motor, or the space required by the motor.

The invention has been described in detail sufficient to enable one skilled in the art to make and use the same. It is believed that various alterations and modifications of the invention may occur to those skilled in the art upon a reading and understanding of the present specification, and it is intended that all such alterations and modifications are included within the scope of the invention insofar as the come within the scope of the appended claims.

I claim:

1. A rotary fluid pressure device of the type including housing means defining fluid inlet means and fluid outlet means; an internal gear set associated with said housing means and including an internally-toothed member and an externally-toothed member eccentrically disposed within said internally-toothed member, one of said members having rotational movement about its axis, and one of said members having orbital movement about the axis of the other member, the teeth of said members interengaging to define expanding and contracting volume chambers during said movements; valve means operable in response to one of said movements to communicate fluid from said fluid inlet means to one of said expanding and contracting fluid chambers, and from the other of said fluid chambers to said fluid outlet means; input-output shaft means, and means operable to transmit torque between said input-output shaft means and one of said toothed members, characterized by:

(a) a lock member operably associated with said internally-toothed member and disposed at least partially within one of said volume chambers;

(b) actuation means operably associated with said lock member and operable to move said lock member between a first position in which said lock member is disposed to permit normal orbital and rotational movement of said toothed members, and a second position in which said lock member extends a sufficient distance into said volume chamber to engage one of the external teeth of said externally-toothed member as said volume chamber approaches minimum chamber volume, to prevent further orbital movement of said member having orbital movement, thereby preventing rotation of said member having rotational movement.

2. A rotary fluid pressure device as claimed in claim 1 characterized by said internally-toothed member defining a recess disposed circumferentially between a pair of adjacent internal teeth, said lock member being disposed at least partially within said recess and being radially movable therein.

3. A rotary fluid pressure device as claimed in claim 1 characterized by said lock member comprising an elongated, generally cylindrical member defining an axis oriented generally parallel to said axis of said member having rotational movement.

4. A rotary fluid pressure device as claimed in claim 1 characterized by said actuation means comprising said internally-toothed member defining a generally radially-extending opening and adjustment means disposed within said opening, and operable to move said lock member between said first and second positions in response to input movement to said adjustment means.

5. A rotary fluid pressure device as claimed in claim 1 characterized by movement of said lock member between said first and second positions requiring radial movement of said lock member of less than 0.100 inches (2.54 mm).

6. A gerotor displacement mechanism of the type including an internally-toothed member having a plurality (N+1) of internal teeth, and an externally-toothed member eccentrically disposed within said internally-toothed member and having a plurality (N) of external teeth, said members being configured to have relative orbital and rotational motion therebetween, the teeth of said members interengaging to define expanding and contracting volume chambers during said relative motion, characterized by:

(a) a lock member operably associated with said internally-toothed member and disposed at least partially within one of said volume chambers;

(b) actuation means operably associated with said lock member and operable to move said lock member between a first position in which said lock member is disposed to permit normal relative orbital and rotational motion between said toothed members, and a second position in which said lock member is moved a sufficient distance into said volume chamber to engage one of said external teeth of said externally-toothed member as said volume chamber approaches minimum chamber volume, to block further relative orbital motion between said members, thereby preventing further relative rotational motion between said members.

7. A gerotor displacement mechanism as claimed in claim 6 characterized by said internally-toothed member defining a recess disposed circumferentially between a pair of adjacent internal teeth, said lock member being disposed at least partially within said recess and being radially movable therein.

8. A gerotor displacement mechanism as claimed in claim 6 characterized by said lock member comprising an elongated, generally cylindrical member defining an axis oriented generally parallel to the axis of said member having rotational movement.

9. A gerotor displacement mechanism as claimed in claim 6 characterized by said actuation means comprising said internally-toothed member defining a generally radially-extending opening and adjustment means disposed within said opening, and operable to move said lock member between said first and second positions in response to input movement to said adjustment means.

10. A gerotor displacement mechanism as claimed in claim 6 characterized by movement of said lock member between said first and second positions requiring radial movement of said lock member of less than 0.100 inches (2.54 mm).

11. A gerotor displacement mechanism as claimed in claim 9 characterized by said adjustment means comprising an externally-threaded actuator member in threaded engagement with said radially-extending opening, whereby rotation of said actuator member results in radial movement thereof between said first and second positions.

12. A gerotor displacement mechanism as claimed in claim 11 characterized by said actuation means including a back-up member operable to transmit radially inward movement of said actuator member to said lock member, said back-up member including sealing means to substantially prevent leakage of fluid from said volume chamber through said radially-extending opening.

13. A gerotor displacement mechanism of the type including a housing, an internally-toothed member disposed said housing and having a plurality (N+1) of internal teeth, an externally-toothed member eccentrically disposed within said internally-toothed member and having a plurality (N) of external teeth, the teeth of said members interengaging to define expanding and contracting volume chambers during relative motion therebetween, said externally-toothed member being mounted for solely rotational movement about its axis, and said internally-toothed member and said housing including means restraining rotational movement of said internally-toothed member and permitting solely orbital movement thereof, characterized by:

(a) a lock member operably associated with said housing and disposed radially adjacent said internally-toothed member;

(b) actuation means operably associated with said lock member and being operable to move said lock member between a first position in which said lock member is disposed to permit normal orbital movement of said internally-toothed member, and a second position in which said lock member is moved to a position radially inwardly a sufficient distance to engage said internally-toothed member to block further orbital movement thereof and prevent further rotational movement of said externally-toothed member.

14. A gerotor displacement mechanism as claimed in claim 13 characterized by said lock member comprising an elongated, generally cylindrical member defining an axis oriented generally parallel to the axis of said externally-toothed member.

15. A gerotor displacement mechanism as claimed in claim 13 characterized by said actuation means comprising said housing defining a generally radially-extending opening and adjustment means disposed within said opening, and being operable to move said lock member between said first and second positions in response to input movement to said adjustment means.

16. A gerotor displacement mechanism as claimed in claim 15 characterized by said adjustment means comprising an externally-threaded actuator member in threaded engagement with said radially-extending opening, whereby rotation of said actuator member results in radial movement thereof between said first and second positions.

17. A rotary fluid pressure device of the type including housing means defining fluid inlet means and fluid outlet means; an internal gear set associated with said housing means and including an internally-toothed member and an externally-toothed member, one of said members having rotational movement about its axis, and one of said members having orbital movement about the axis of the other member, the teeth of said members interengaging to define expanding and contracting volume chambers during said movements; valve means operable in response to one of said movements to communicate fluid from said fluid inlet means to one of said expanding and contracting fluid chambers, and from the other of said fluid chambers to said fluid outlet means; input-output shaft means, and means operable to transmit torque between said input-output shaft means and one of said toothed members, characterized by:

(a) a lock member operably associated with one of said housing means and said internally-toothed member; and (b) actuation means operably associated with said lock member and operable to move said lock member between a first position in which said lock member is disposed to permit normal orbital and rotational movement of said toothed member, and a second position in which said lock member is disposed to engage a surface defined by said one of said members having orbital movement, said surface being oriented generally parallel to said axis of said member having rotational movement, to limit further orbital movement thereof, thereby preventing rotation of said member having rotational movement.

18. A rotary fluid pressure device as claimed in claim 17 characterized by said lock member being operably associated with said internally-toothed member.

19. A rotary fluid pressure device as claimed in claim 17 characterized by said second position of said lock member comprising said lock member extending a sufficient distance into said volume chamber to engage one of the external teeth of said externally-toothed member as said volume chamber approaches minimum chamber volume.

20. A rotary fluid pressure device as claimed in claim 19 characterized by said movement of said lock member between said first and second positions comprising radial movement of said lock member.

21. A gerotor displacement mechanism of the type including a housing means, internally-toothed member having a plurality (N+1) of internal teeth, and an externally-toothed member eccentrically disposed within said internally-toothed member and having a plurality (N) of external teeth, said members being configured to have relative orbital and rotational motion therebetween, the teeth of said members interengaging to define expanding and contracting volume chambers during said relative motion, characterized by:

(a) a lock member operably associated with one of said housing means and said internally-toothed member; and (b) actuation means operably associated with said lock member and operable to move said lock member between a first position in which said lock member is disposed to permit normal relative orbital and rotational motion between said toothed member, and a second position in which said lock member is disposed to engage a surface defined by said one of said members having orbital movement, said surface being oriented generally parallel to said axis of said member having rotational movement, to limit further orbital movement thereof, thereby preventing rotation of said member having rotational movement.

22. A gerotor displacement mechanism as claimed in claim 21 characterized by said lock member comprising an elongated, generally cylindrical member defining an axis oriented generally parallel to the axis of said member having rotational movement.

23. A rotary fluid pressure device as claimed in claim 21 characterized by said lock member being operably associated with said internally-toothed member.

24. A rotary fluid pressure device as claimed in claim 21 characterized by said second position of said lock member comprising said lock member extending a sufficient distance into said volume chamber to engage one of the external teeth of said externally-toothed member as said volume chamber approaches minimum chamber volume.

25. A rotary fluid pressure device as claimed in claim 24 characterized by said movement of said lock member between said first and second positions comprising radial movement of said lock member.

* * * * *